US008714639B2

(12) United States Patent
Heisey

(10) Patent No.: US 8,714,639 B2
(45) Date of Patent: May 6, 2014

(54) INFANT CARRIER WITH HANDLE

(75) Inventor: Nathan W. Heisey, Seymour, IN (US)

(73) Assignee: Cosco Management, Inc., Wilmington, DE (US)

( * ) Notice: Subject to any disclaimer, the term of this patent is extended or adjusted under 35 U.S.C. 154(b) by 0 days.

(21) Appl. No.: 13/544,826

(22) Filed: Jul. 9, 2012

(65) Prior Publication Data

US 2013/0009428 A1 Jan. 10, 2013

(51) Int. Cl.
*B60N 2/26* (2006.01)
*B60N 2/28* (2006.01)

(52) U.S. Cl.
USPC ..... 297/183.4; 297/183.3; 297/250.1; 297/256.16

(58) Field of Classification Search
USPC ..... 297/183.3, 183.4, 250.1, 256.16
See application file for complete search history.

(56) References Cited

U.S. PATENT DOCUMENTS

| | | | | |
|---|---|---|---|---|
| 4,634,177 | A | 1/1987 | Meeker | |
| 5,522,639 | A * | 6/1996 | Jaime | 297/183.3 X |
| 5,544,935 | A | 8/1996 | Cone, II et al. | |
| 5,961,180 | A | 10/1999 | Greger et al. | |
| 6,145,927 | A | 11/2000 | Lo | |
| 6,443,522 | B1 | 9/2002 | Kain et al. | |
| 6,561,577 | B2 | 5/2003 | Kelly | |
| 6,913,313 | B2 * | 7/2005 | Sedlack | 297/183.4 X |
| 7,455,354 | B2 | 11/2008 | Jane Santamaria | |
| 7,488,034 | B2 * | 2/2009 | Ohren et al. | 297/256.16 X |
| 2008/0067845 | A1 | 3/2008 | Ohren et al. | |

* cited by examiner

*Primary Examiner* — Rodney B White
(74) *Attorney, Agent, or Firm* — Barnes & Thornburg LLP

(57) ABSTRACT

An infant carrier includes a seat bucket and a carrier handle. The carrier handle is coupled to the seat bucket and is movable between a storage position extending along the seat bucket and a carry position extending up and over the seat bucket.

29 Claims, 7 Drawing Sheets

INFANT CARRIER WITH HANDLE

PRIORITY CLAIM

This application claims priority to Chinese Utility Model Application No. 201120247648.0, filed Jul. 8, 2011, which application is hereby incorporated in its entirety herein.

BACKGROUND

The present disclosure relates to infant carriers and, in particular, to an infant carrier including a seat bucket for supporting a child and a carrier handle for use by a caregiver in transporting the infant carrier. More particularly, the present disclosure relates to a movable handle that pivots between a storage position extending along the seat bucket and a carry position extending up over the seat bucket.

SUMMARY

An infant carrier in accordance with the present disclosure includes a seat bucket and a carrier handle. The carrier handle is coupled to the seat bucket to pivot about a handle axis between a storage position and a carry position. In the storage position, the carrier handle extends in a rearward direction along the seat bucket. In the carry position, the carrier handle extends in an upward direction up and over the seat bucket.

In illustrative embodiments, the infant carrier further includes a handle lock coupled to the carrier handle to move therewith. The handle lock is movable between a locked position and an unlocked position. When the handle lock is in the locked position, movement of the carrier handle relative to the seat bucket is blocked. When the handle lock is in the unlocked position, the carrier handle is freed to pivot about the handle axis relative to the seat bucket.

In illustrative embodiments, the handle lock includes an input surface. The input surface is configured to provide means for receiving an input force from a caregiver to cause the handle lock to move from the locked position to the unlocked position while arranging the input surface to lie in collinear relation with a curved forward surface included in the carrier handle when the handle lock is in the locked position so that the carrier handle has an appearance of having a continuous forward surface.

In illustrative embodiments, the handle lock further includes a lock block and a lever. The lock block is coupled to the carrier handle to slide back and forth between the locked and unlocked position in response to application of the input force. The lever is coupled to the carrier handle to pivot about the handle axis between the locked and the unlocked position. The lever provides the input surface.

In illustrative embodiments, the handle lock further includes a spring. The spring is positioned to lie between the lock block and the carrier handle. The spring is configured to provide a bias force to the lock block to urge the lock block and lever to assume the locked position and to maintain the input surface in collinear relation with the curved forward surface of the carrier handle.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
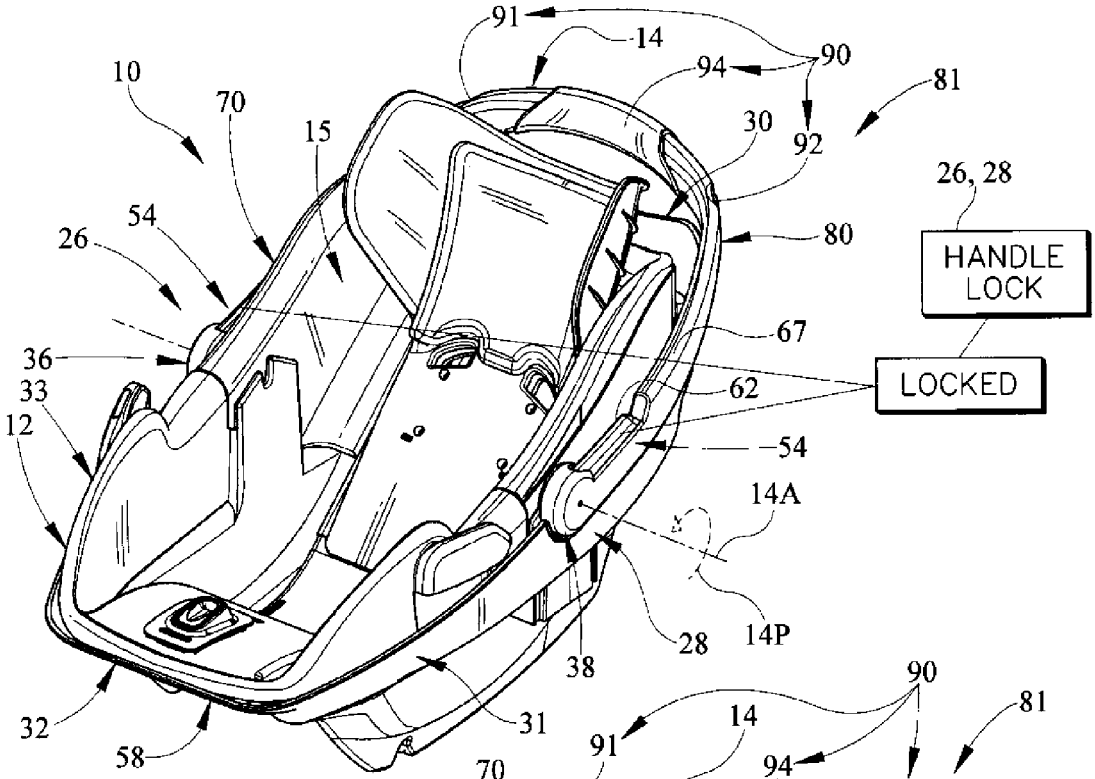
FIG. 1 is a perspective view of an infant carrier in accordance with the present disclosure showing that the infant carrier includes a seat bucket and a carrier handle coupled to the seat bucket and arranged in a storage position that extends in a rearward direction along the seat bucket and showing that the infant carrier further includes left and right handle locks coupled to the carrier handle and arranged in a locked position that block movement of the carrier handle about a lateral handle axis.
Figure 2:
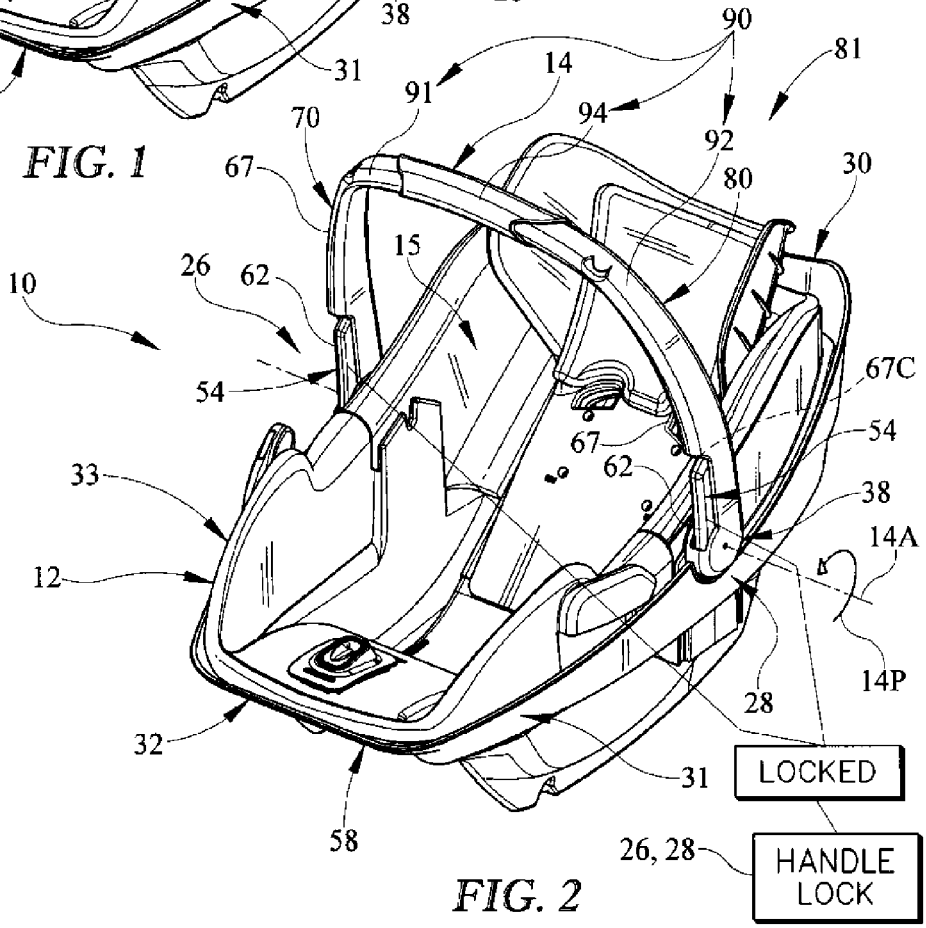
FIG. 2 is a view similar to FIG. 1 showing the carrier handle moved about the lateral handle axis in a counter-clockwise direction from the storage position of FIG. 1 to a carry position in which the carrier handle extends in an upward direction up and over the seat bucket.

An infant carrier 10 in accordance with the present disclosure includes a seat bucket 12, a carrier handle 14, and left and right handle locks 26, 28 as shown in FIGS. 1 and 2. Carrier handle 14 is coupled to seat bucket 12 to pivot about a handle axis 14A between a storage position shown in FIG. 1 and a carry position shown in FIG. 2. Handle locks 26, 28 are coupled to carrier handle 14 to move between a locked position in which movement of carrier handle 14 is blocked and an unlocked position in which carrier handle 14 is freed to move about handle axis 14A. As shown in FIGS. 4A and 4B, each handle lock 26, 28 includes an input surface 62 that is configured to provide means for receiving an input force 54F from a user to cause handle locks 26, 28 to move from the locked position to the unlocked position while arranging input surface 62 to lie in collinear relation with a curved forward surface 67 of carrier handle 14 when handle locks 26, 28 are in the locked position so that the carrier handle has an appearance 81 of having a continuous forward surface 67C as shown in FIGS. 1 and 2.

Figure 4:
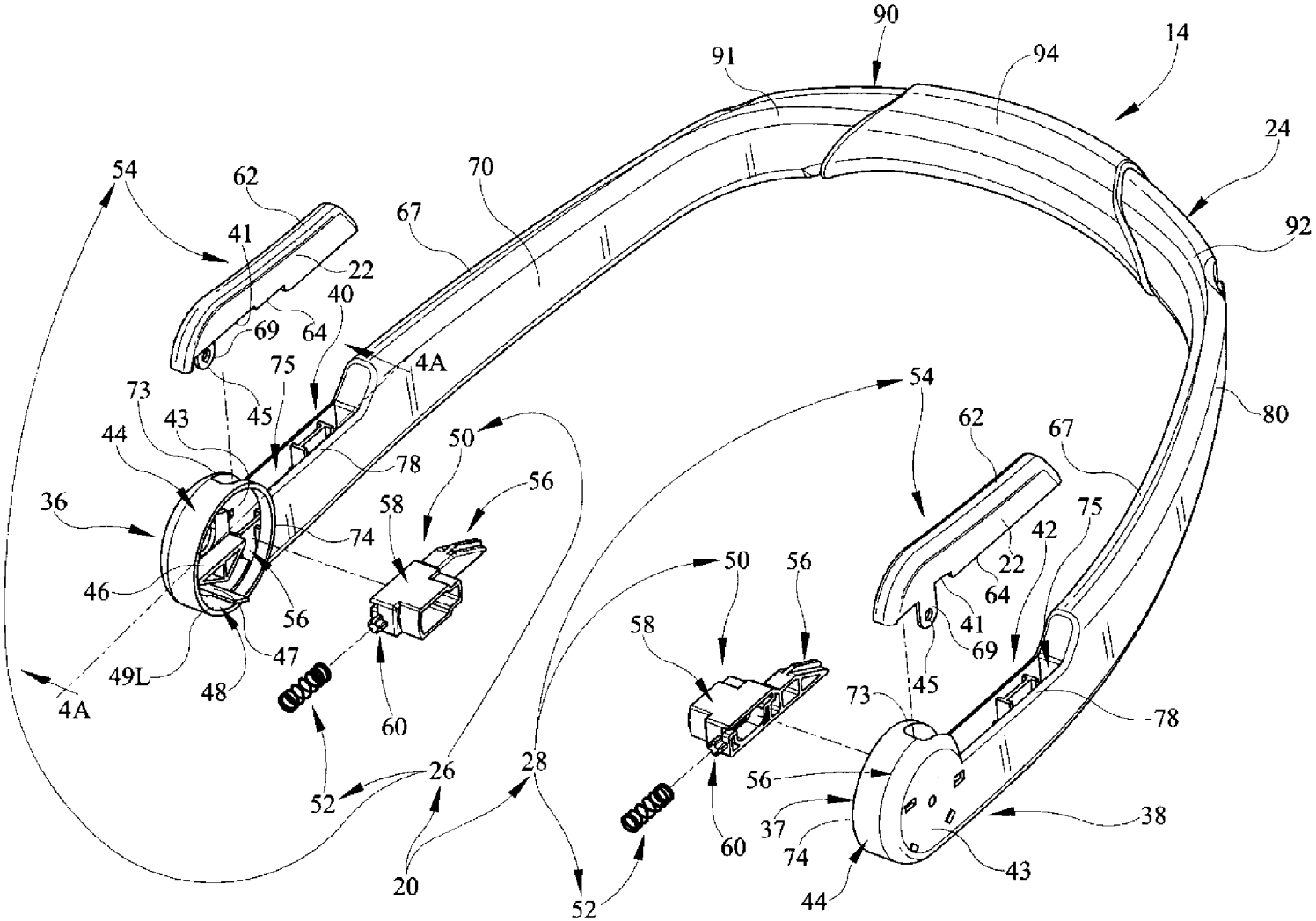
FIG. 4 is an exploded assembly view of the carrier handle and handle locks of FIGS. 1-3 showing that each handle lock includes, from top to bottom, a lever including an input surface that is arranged to lie collinear relation with a curved forward surface of the carrier handle when the handle lock is in the locked position, a lock block coupled to the carrier handle to slide back and forth, and a spring configured to bias normally the handle lock to the locked position.
Figure 4A:
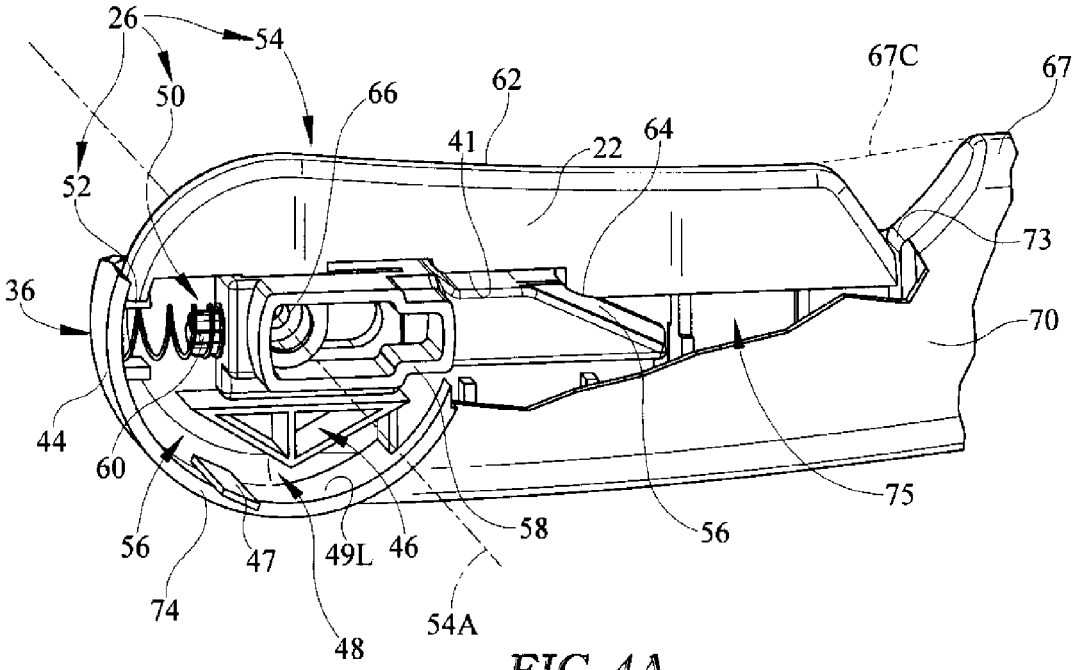
FIG. 4A is a sectional view taken along line 4A-4A of FIG. 4 showing the handle lock in the locked position and showing that the input surface of the lever is in collinear alignment with the curved forward surface of the carrier handle when no input force is applied to the lever.
Figure 4B:
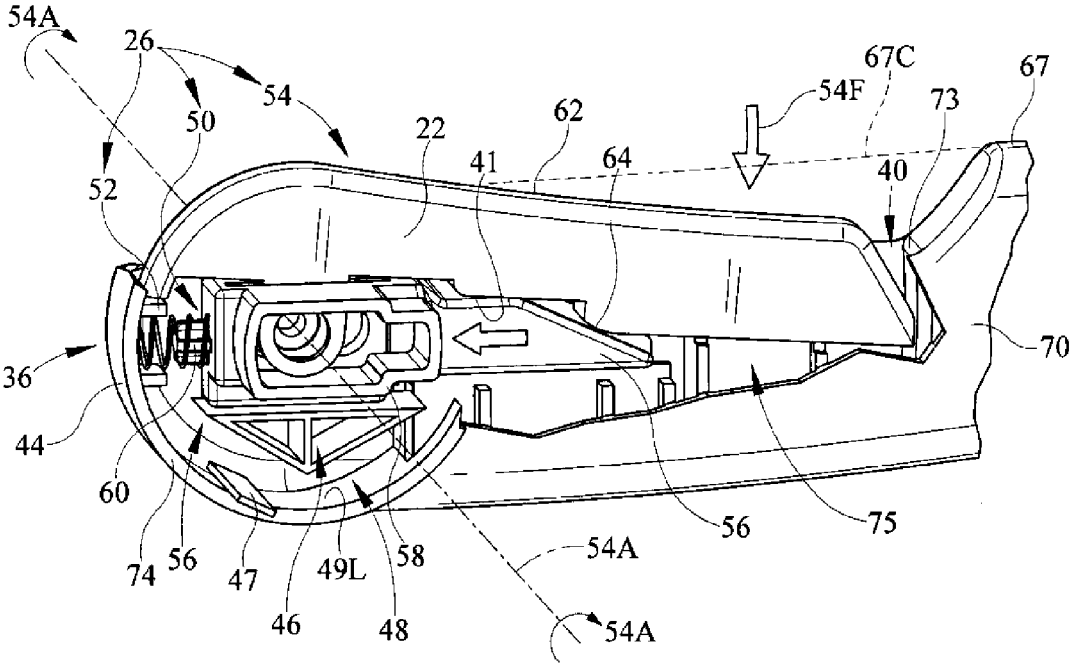
FIG. 4B is a view similar to 4A showing the handle lock in the unlocked position as a result of applying the input force (solid double arrow) to the lever causing the lever to pivot in a clockwise direction about a lever axis so that the lever engages and moves the lock block toward the spring.

Left and right handle locks 26, 28 cooperate to establish a handle-lock mechanism 20 as shown in FIG. 4. Left and right handle locks 26, 28 each include input surface 62 configured to be in collinear relation with curved forward surfaces 67 of carrier handle 14 when left and right handle locks 26, 28 are in the locked position. Input surface 62 moves in a downward direction toward carrier handle 14 as a result of receiving input force 54F to the unlocked position as shown in FIGS. 4A and 4B. As a result, input surface 62 moves out of collinear relation with curved forward surfaces 67 of carrier handle 14.

Left handle lock 28 is substantially the same as right handle lock 26, and thus, only left handle lock 28 will be discussed in detail. As shown in FIGS. 4-4B, left handle lock 28 includes a lever 54, a lock block 50, and a spring 52. Lock block 50 is coupled to carrier handle 14 to engage seat bucket 12 and block carrier handle 14 from pivoting about lever axis 54A relative to seat bucket 12. Spring 52 biases lock block 50 toward engagement with seat bucket 12. Lever 54 moves lock block 50 out of engagement with seat bucket 12 in response to application of input force 54F as suggested in FIGS. 4A and 4B.

Lever 54 includes, for example, a lever body 22, an actuator ramp 64, and a pivot flange 69 as shown, for example, in FIGS. 4-4B. Lever body 22 includes input surface 62 arranged to face away from carrier handle 14 and an opposite lower surface 41 that is arranged to face opposite input surface 62 toward carrier handle 14 as shown in FIGS. 4A and 4B. Pivot flange 69 is coupled to lower surface 41 of lever body 22 to extend toward lever axis 54A as shown in FIGS. 4A and 4B. Actuator ramp 64 is appended to lower surface 41 of lever body 22 and is arranged to lie in spaced-apart relation to pivot flange 69. Actuator ramp 64 is arranged to extend toward carrier handle 14 to engage lock block 50 as shown in FIG. 4B. As an example, lever 54 is monolithic and made of a plastics material.

When handle lock 28 is in the locked position, input surface 62 of lever 54 is arranged to lie in collinear relation with curved forward surface 67 of carrier handle 14 as shown in FIG. 5A. When a user applies input force 54F to input surface 62 of lever 54, lever 54 pivots in a clockwise direction about lever axis 54A toward seat bucket 12. As a result, handle lock 28 is in the unlocked position and input surface 62 is no longer in collinear alignment with curved forward surface 67 of carrier handle 14. When a user removes input force 54F from input surface 62, spring 52 urges lever 54 to pivot in an opposite counter-clockwise direction away from carrier handle 14. As a result, handle lock 28 returns to the locked position and input surface 62 is arranged to lie in collinear relation with curved forward surface 67.

Figure 3:
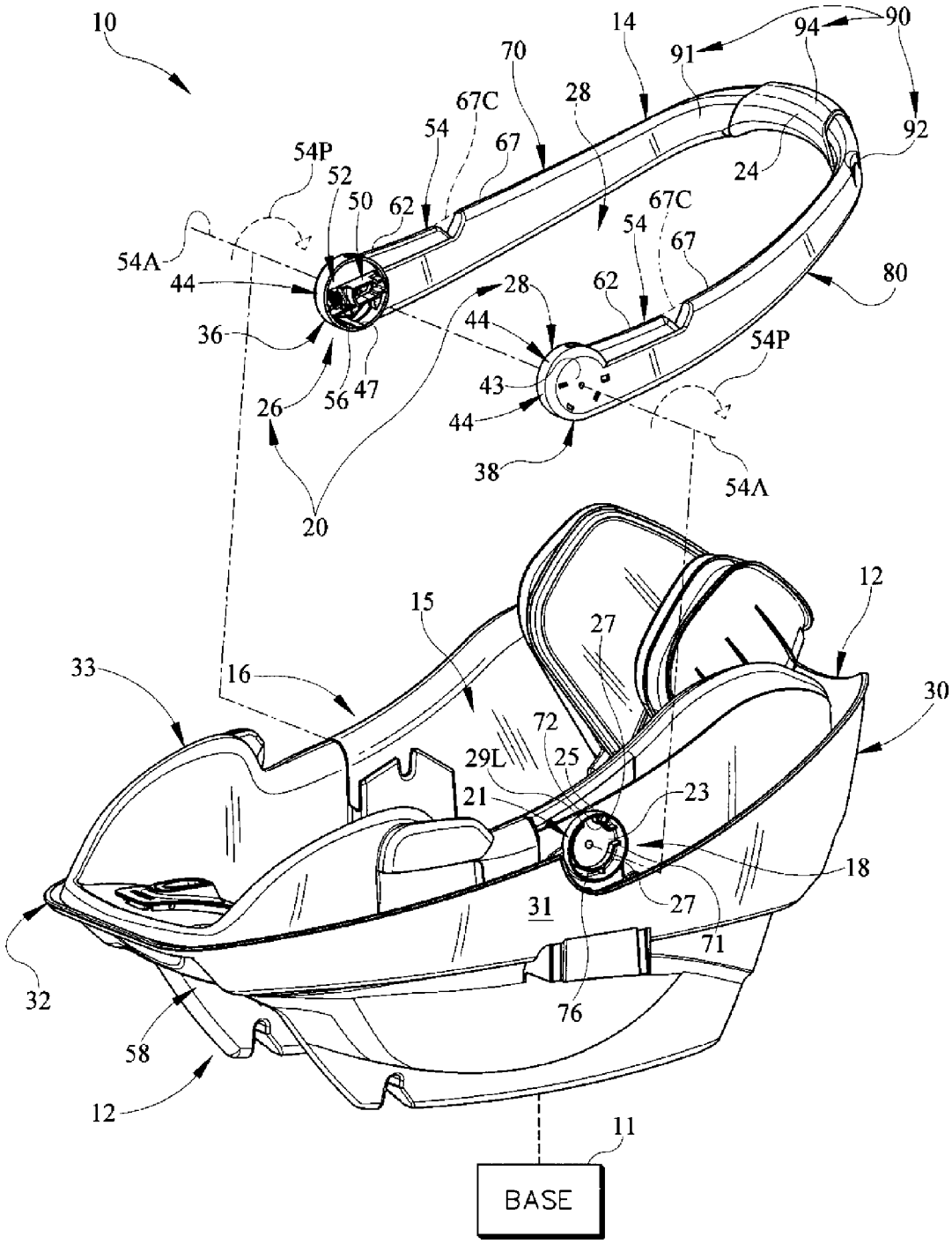
FIG. 3 is a partially exploded assembly view and diagrammatic view of a juvenile restraint showing that the juvenile restraint includes, from top to bottom, the infant carrier including the carrier handle including a U-shaped grip, a left hub, and a right hub, left and right handle locks carried on the carrier handle, the seat bucket including a left socket coupled to a left side of the seat bucket and a right socket coupled to a right side of the seat bucket and a base adapted to support the infant carrier on a vehicle seat included in a vehicle.

Lever 54 pivots about lever axis 54A when a user applies input force 54F, as suggested by lever-movement direction 54P in FIG. 3. As an example, lever axis 54A and handle axis 14A are aligned to lie in collinear relation to one another. Pivot flange 69 is formed to include a pin hole 45 and couples lever 54 to carrier handle 14 for pivotable movement about lever axis 54A relative to carrier handle 14. Pivot flange 69 facilitates movement of lever 54 to unlock handle lock 28 and to move input surface 62 out of collinear alignment with curved forward surface 67, also called forward surface 67, of carrier handle 14.

As illustrated in FIGS. 4-4B, 6, and 8, lock block 50 includes a locator wedge 56, a latch body 58, and a spring mount 60. Locator wedge 56 is append to latch body 58 to extend away from lever axis 54A toward grip 24 included in carrier handle 14 as shown in FIGS. 4A and 4B. Spring mount 60 is append to lock block 50 and arranged to extend opposite from locator wedge 56 away from lever axis 54A and grip 24. Actuator ramp 64 of lever 54 engages locator wedge 56 to cause lock block 50 to move out of engagement with seat bucket 12 as a result of a user applying input force 54F to input surface 62 of lever 54. Latch body 58 of lock block 50 is configured to engage with seat bucket 12 and is biased into engagement with seat bucket 12 by spring 52. Spring 52 is coupled to spring mount 60 and configured to provide a bias force to latch body 58 that urges latch body 58 to engage seat bucket 12 and return handle lock 28 to the locked position.

Figure 5:
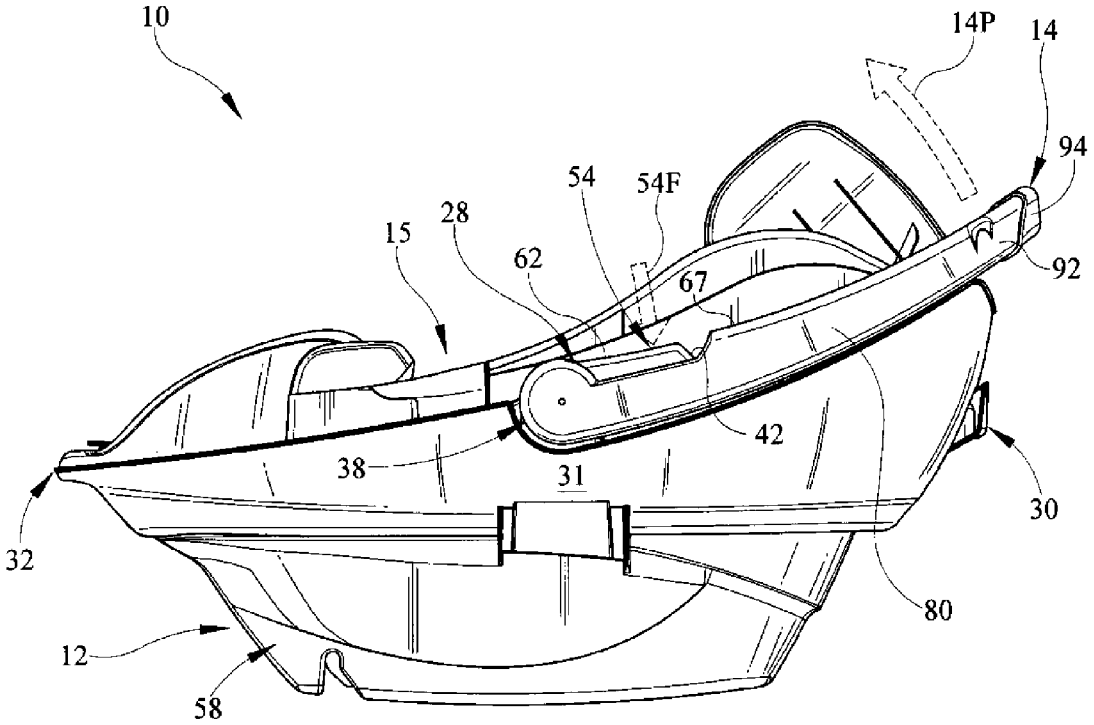
FIG. 5 is a right side elevation view of the infant carrier of FIG. 1 showing the handle lock in the locked position in which the input surface of the lever is aligned in collinear relation with the curved forward surface of the carrier handle and suggesting that when the input force (phantom double arrow) is applied to the input surface, the handle lock is moved to the unlocked position as suggested in FIGS. 7 and 8 and the carrier handle is freed to pivot about the handle axis from the storage potion to the carry position suggested in FIGS. 9 and 10.
Figure 6:
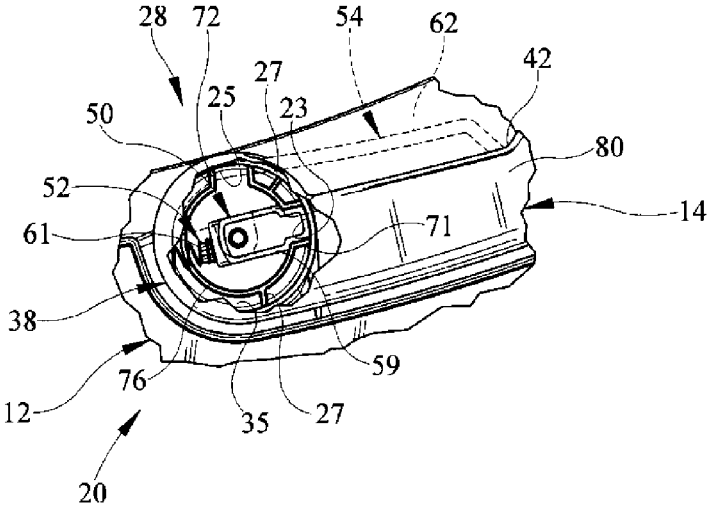
FIG. 6 is an enlarged partial perspective view of the infant carrier of FIG. 5 with portions broken away to reveal that the lock block of the handle lock engages the socket of the seat bucket to block the carrier handle from pivoting from the storage position to the carry position when the lever of the handle lock is in the locked position.
Figure 7:
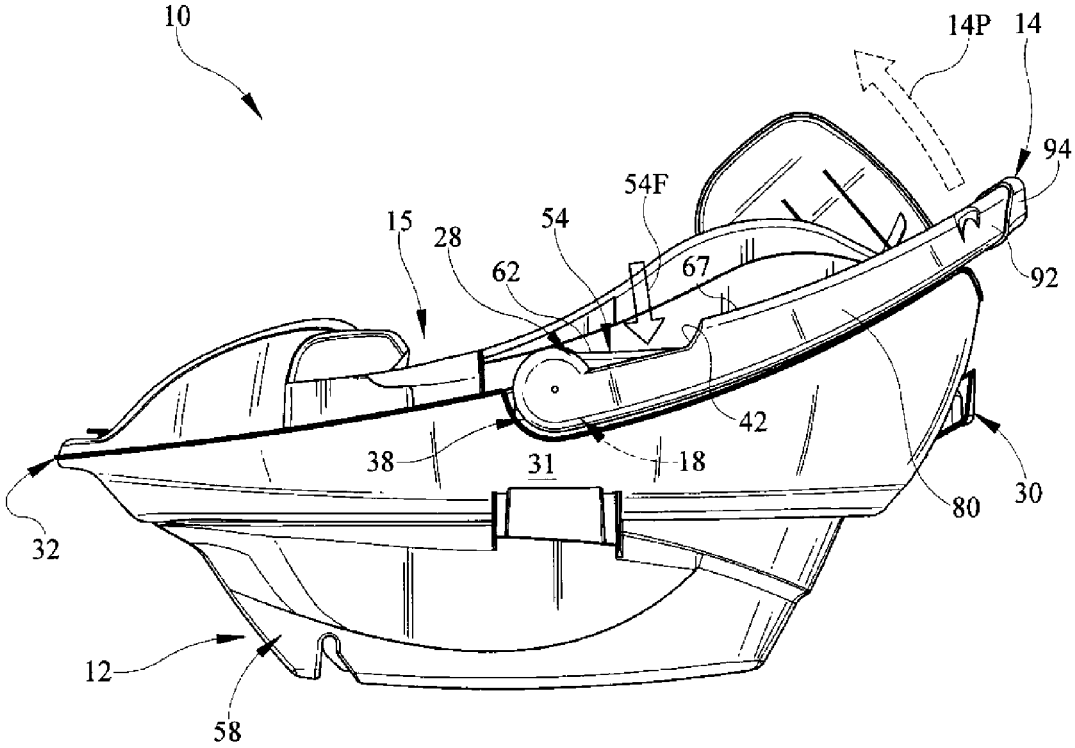
FIG. 7 is a view similar to FIG. 5 showing that the lever included in the handle lock has been pivoted downwardly as a result of applying the input force to the input surface causing the input surface of the lever to no longer be arranged in collinear relationship with the forward surface of the carrier handle so that the carrier handle is freed to pivot from the storage position to the carry position as suggested in FIG. 9.
Figure 8:
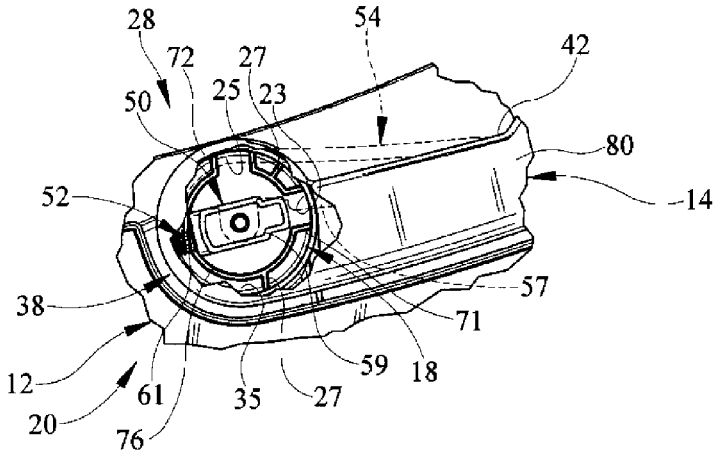
FIG. 8 is an enlarged partial perspective view of the infant carrier of FIG. 7 with portions broken away to reveal that the lock block of the handle lock has withdrawn from a storage socket formed in the seat bucket so that the carrier handle is free to pivot from the storage position to the carry position.
Figure 9:
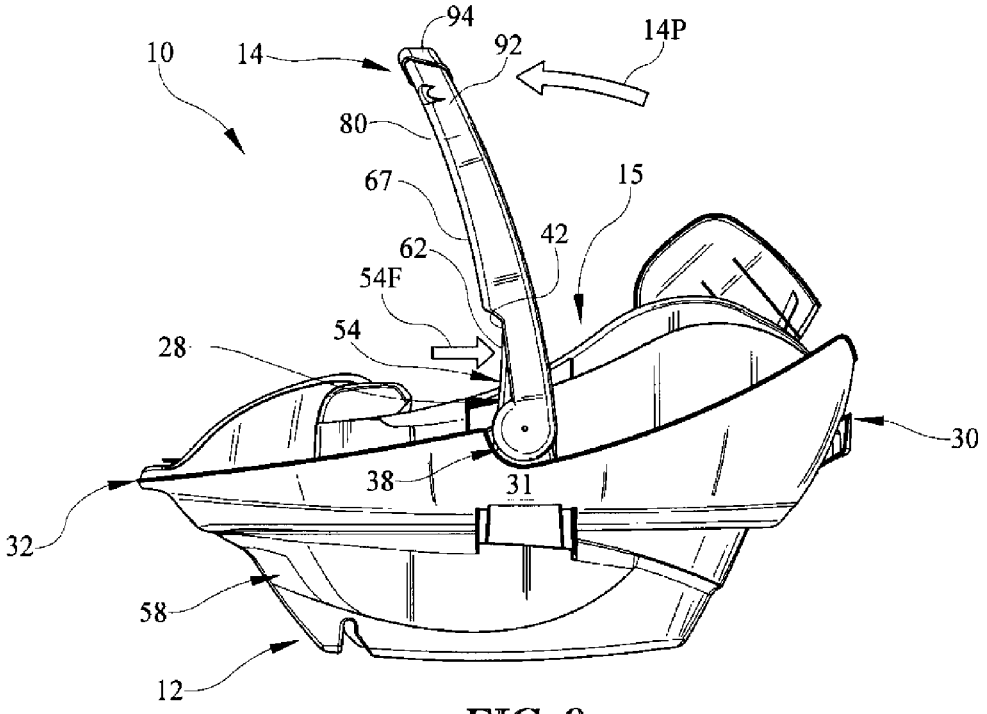
FIG. 9 is a view similar to FIGS. 5 and 7 showing the handle lock in the unlocked position and the carrier handle pivoted in the counter-clockwise direction about the handle axis from the storage position of FIGS. 5 and 7 to the carry position.
Figure 10:
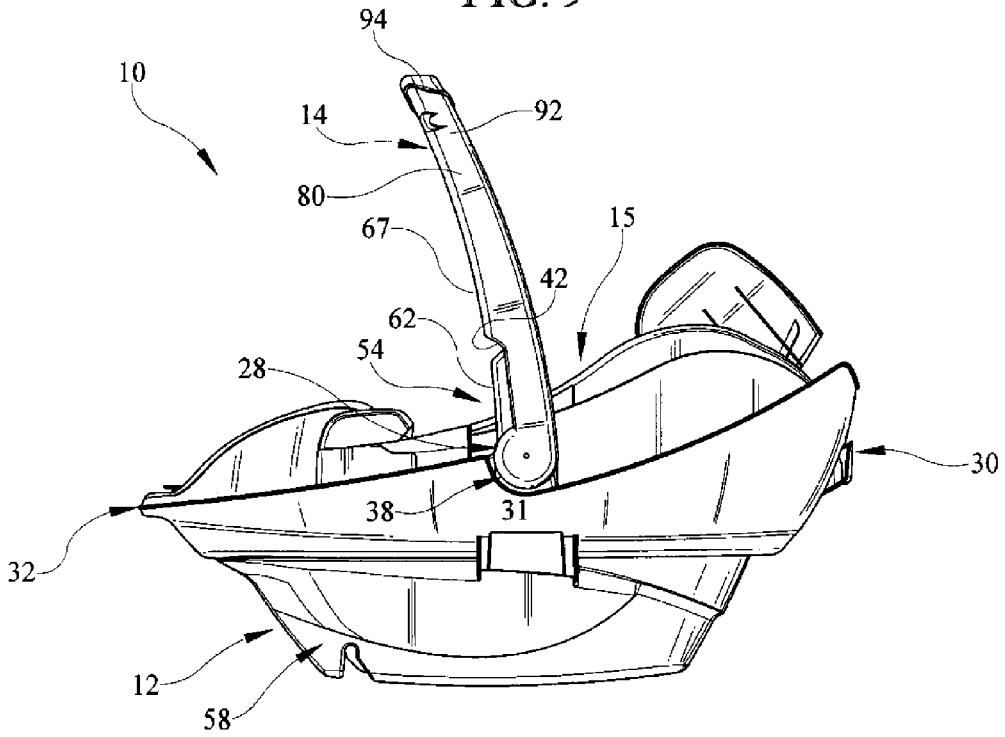
FIG. 10 is view similar to FIG. 9 showing the handle lock has returned to the locked position as a result of removing the input force and allowing the spring included in the handle lock to return the handle lock to the locked position with the input surface of the handle again aligning in collinear relation with the forward surface of the carrier handle.

Left and right handle locks 26, 28 are biased to block carrier handle 14 from pivoting about lever axis 54A between the storage position shown in FIGS. 1, 5, and 7 and the carry position shown in FIGS. 2, 9, and 10. In an example of use, carrier handle 14 begins in the storage position and handle locks 26, 28 are biased to the locked position as shown in FIGS. 5 and 6. A user applies input force 54F to input surfaces 62 of handle locks 26, 28 to overcome the bias force provided by springs 52 and move handle locks 26, 28 to the unlocked position as suggested in FIG. 5 and shown in FIGS. 7 and 8. As a result of handle locks 26, 28 being in the unlocked position, carrier handle 14 is freed to pivot about handle axis 14A from the storage position of FIGS. 5 and 7 to the carry position as shown in FIG. 9. After the user removes input force 54F to input surfaces 62 springs 52 provide bias force to return handle locks 26, 28 to the locked position retaining carrier handle 14 in the carry position as shown in FIG. 10.

During application of input force 54F to input surfaces 62 of handle locks 26, 28, levers 54 pivot in a clockwise direction about lever axis 54A as shown in FIGS. 4A and 4B. As a result, input surfaces 62 move out of collinear alignment with curved forward surface 67 of carrier handle 14 to cause actuator ramp 64, included in each lever 54, to engage lock blocks 50 as suggested in FIGS. 4A and 4B. Lock blocks 50 are caused to translate away from grip 24. As lock blocks 50 translate away from grip 24, they withdraw from engagement with seat bucket 12 as shown in FIGS. 6 and 8 causing handle locks 26, 28 to assume the unlocked position. Carrier handle 14 is now freed to pivot about handle axis 14A to one of the storage position and the carry position.

After input force 54F is withdrawn from input surfaces 62, springs 52 drive lock blocks 50 toward grip 24. As a result, lock blocks 50 engage and pivot levers 54 in a counter-clockwise direction about lever axis 54A so that handle locks 26, 28 return to the locked position. As a result, input surfaces 62 return to lie in collinear relation with curved forward surface 67 as illustrated in FIG. 10.

Input surface 62 of handle locks 26, 28 are configured to be visible from either the storage position or the carry position to provide easy accessibility to handle locks 26, 28. As illustrated in FIGS. 1 and 2, input surfaces 62 are visible above infant carrier 10 when carrier handle 14 is in the storage position and from a front of infant carrier 10 when carrier handle 14 is in the carry position. In addition, alignment of input surfaces 62 with curved forward surface 67 provides a pleasing aesthetic appearance.

Seat bucket 12 of infant carrier 10 includes a bucket body 58, a right socket 16, and a left socket 18 as shown in FIG. 3. Bucket body 58 is formed to include a seat channel 15. Seat channel 15 supports a child (not shown) seated in infant carrier 10. Right socket 16 is situated along a right side 33 of bucket body 58 and opens outwardly, away from seat channel 15. Left socket 18 is situated along a left side 31 of bucket body 58 and opens outwardly away from seat channel 15. Seat bucket 12 is also configured to couple selectively with a base 11 shown diagrammatically in FIG. 3. Base 11 may be configured to be secured in a vehicle seat included in a vehicle or a be a stroller.

Sockets 16, 18 of seat bucket 12 are substantially the same and therefore only left socket 18 will be discussed in detail. As shown in FIG. 3, left socket 18 includes a round side wall 21, a first lock-block receiver 71, a second lock-block receiver 72, a support platform 27, and a guide member 76 as shown in FIGS. 6 and 8. Support platform 27 is positioned to lie radially between first and second lock-block receivers 71, 72. First lock-block receiver 71 is formed to include a storage slot 23 therein and a portion of lock block 50 is received therein when handle lock 26 is in the locked position and carrier handle 14 is in the storage position. Second lock-block receiver 72 is formed to include a carry slot 25 therein and a portion of lock block 50 is received therein when handle lock 26 is in the locked position and carrier handle 14 is in the carry position. When handle lock 26 is in the unlocked position, lock block 50 is withdrawn from and spaced apart from storage slot 23 and carry slot 25. Support platform 27 engages with carrier handle 14 to guide pivoting of carrier handle 14 and blocks carrier handle 14 from pivoting about handle axis 14A past the storage position and the carry position. Guide member 76 and round side wall 21 cooperate to define a guide channel 77 therebetween which limits travel of carrier handle 14 between the carry and the storage position.

Carrier handle 14 may be a monolithic component formed from a plastics material. Carrier handle 14 includes, for example, grip 24, a left handle hub 38, and a right handle hub 36. Grip 24 includes a right arm 70, a left arm 80, and a top connection member 90 coupled to and interconnecting left arm 80 and right arm 70 as shown in FIGS. 1-4. Right arm 70 and right handle hub 36 are configured to couple to right socket 16 situated along right side 33 of seat bucket 12. Similarly, left arm 80 and left handle hub 38 are configured to couple to left socket 18 located along left side 31 of seat bucket 12.

Top connection member 90 includes a right side 91, a left side 92, and a gripping portion 94. Right side 91 interconnects gripping portion 94 and right arm 70, left side 92 interconnects gripping portion 94 and right arm 70. Gripping portion 94 spans between right side 91 and left side 92 to provide a comfortable gripping surface for a user to hold onto when carrying infant carrier 10. As an example, top connecting member 90, left arm 80, and right arm 70 are arranged to be U-shaped.

When carrier handle 14 is in the storage position, top connection member 90 is positioned to lie along a head end 30 of seat channel 15 that is spaced apart from a foot end 32 of seat channel 15 as shown in FIG. 1. Right arm 70 of carrier handle 14 extends from right side 33 away from foot end 32 and toward head end 30. Left arm 80 extends from left side 31 away from foot end 32 toward head end 30. In this way, a caregiver can access seat channel 15 to position a child in seat channel 15 without obstruction by carrier handle 14. When carrier handle 14 is in the carry position, right arm 70 and left arm 80 extend up away from seat bucket 12 and top connection member 90 extends across seat channel between head end 30 and foot end 32 of seat channel to facilitate a user carrying a child positioned in seat channel 15 by holding top connection member 90 with a minimum of one hand.

Left handle hub 38 of carrier handle 14 is substantially the same as right handle hub 36, and thus, only left handle hub 38 will be discussed in detail. Left handle hub 38 cooperates with left socket 18 of seat bucket 12 to provide rotative bearing engagement between carrier handle 14 and seat bucket 12. As suggested in FIG. 4, left handle hub 38 is formed to include a lock-block space 56 in which a portion of lock block 50 is arranged to lie. Left handle hub 38 is also formed to include a first hub aperture 73 and a second hub aperture 74 as shown in FIG. 4. First hub aperture 73 opens into lock-block space 56 and lever 54 is arranged to extend out of lock-block space 56 and through first hub aperture 73 to cause input surface 62 of handle lock 28 to be exposed. Second hub aperture 74 opens into lock-block space 56 and handle axis 14A and a portion of lock block 50 is arranged to extend through second hub aperture 74.

Left arm 80 of grip 24 included in carrier handle 14 is formed include a lever space 75 therein as suggested in FIG. 4. Left arm 80 is further formed to include a lever aperture 78 that is arranged to open into lever space 75. Lever 54 is arranged to extend out of lever space 75 through lever aperture 78 when handle lock 28 is in both the locked and unlocked positions. As an example, first hub aperture 73 opens into lever space 75 to cause lever space 75 and lock-block space 56 to communicate with one another such that a first portion of lever 545 is in lock-block space 56, a second portion of lever 54 is in lever space 75, and a third portion of lever 54 is outside both lock-block space 56 and lever space 75.

Right handle hub 36 is substantially the same as left handle hub 38, and thus, only left handle hub 38 will be discussed in detail. Left handle hub 38 is formed to include a floor 43, a side wall 44, a lock support 46, and a guide beam 47. Floor 43 and side wall 44 cooperate to form a cup 48 opening inwardly toward seat channel 15. Side wall 44 extends along handle axis 14A and provides a bearing surface 49L that faces and rides on bearing surface 29L of socket 18 so that left handle hub 38 of carrier handle 14 cooperates with socket 16 to provide rotative bearing engagement between carrier handle 14 and seat bucket 12. Lock support 46 extends inwardly from floor 43 and into cup 48. Guide beam 47 extends inwardly from floor 43 and into guide channel 77 of socket 18. Guide beam 47 is received in guide channel 77 and blocked by a portion of guide member 76 of left socket 18 from pivoting about handle axis 14A past the storage position and the carry position.

In operation, lock blocks 50 slide along lock support 46 of left and right handle hubs 36, 38 of carrier handle 14 when handle-lock mechanism 20 is moved from the locked position to the unlocked position and vice versa. Lock blocks 50 of handle locks 26, 28 resist pivoting of carrier handle 14 by engaging sockets 16, 18 of seat bucket 12 as shown in FIG. 6. To release carrier handle 14 to pivot about handle axis 14A from the storage position to the carry position, a user applies input force 54F on input surfaces 62 of levers 54 included in left and right handle locks 26, 28 such that input surfaces 62 of levers 54 are no longer in collinear alignment with curved forward surface 67 of grip 24 as shown in FIGS. 4B and 7. When levers 54 are pivoted, lock blocks 50 are moved in a direction away from top connection member 90 toward springs 52 resulting in levers 54 being moved out of engagement with storage slot 23 formed in sockets 16, 18 as shown in FIG. 8. Carrier handle 14 is then free to pivot between the storage position and the carry position as suggested by handle-movement direction 14P in FIG. 9.

As shown in FIGS. 4A and 4B, each handle lock 26, 28 includes input surface 62 that receives input force 54F from a user to cause handle locks 26, 28 to move from the locked position to the unlocked position while arranging input surface 62 to lie in collinear relation with curved forward surface 67 of carrier handle 14 when handle locks 26, 28 are in the locked position. As a result, carrier handle 14 has an appearance 81 of having continuous forward surface 67C as shown in FIGS. 1 and 2. Appearance 81 of having continuous forward surface 67C means that curved forward surface 67 of carrier handle 14 appears to continue from grip 24 to hubs 36, 38 even though handle locks 26, 28 interrupt curved forward surface 67 as shown in FIG. 4A.

The invention claimed is:

1. An infant carrier comprising:

a seat bucket formed to include a seat channel adapted to support a child seated on the infant carrier, a carrier handle including a forward surface and an opposite rearward surface spaced apart from the forward surface, the carrier handle being coupled to the seat bucket to move about a handle axis between a storage position in which the carrier handle extends along the seat bucket and the forward surface faces in an upward direction and a carry position in which the carrier handle extends in the upward direction away from the seat bucket and the forward surface faces in a forward direction, and a handle lock having a first end and a second end, the handle lock coupled to the carrier handle to move relative to the carrier handle between a locked position in which the handle lock blocks movement of the carrier handle relative to the seat bucket and an unlocked position in which the carrier handle is free to move relative to the seat bucket, wherein the handle lock includes an input surface that extends between the first and second ends of the handle lock, the input surface configured to provide means for receiving an input force from a user to cause the handle lock to move from the locked position to the unlocked position while arranging the first and second ends of the input surface to lie in collinear relation with the forward surface of the carrier handle when the handle lock is in the locked position so that the carrier handle has an appearance of having a continuous forward surface.

2. The infant carrier of claim 1, wherein the handle lock further includes a lock block coupled to the carrier handle to slide back and forth between the locked and unlocked positions and a lever coupled to the carrier handle to pivot about the handle axis between the locked and the unlocked position and the lever provides the input surface.

3. The infant carrier of claim 2, wherein the handle lock further includes a spring positioned to lie between the lock block and the carrier handle and configured to provide a bias force to the lock block to urge the lock block and the lever to assume the locked position.

4. The infant carrier of claim 3, wherein the lock block includes a latch body, a locator wedge appended to the latch body to extend away from the handle axis in a first direction, and a spring mount appended to the latch body to extend to extend away from the handle axis in an opposite second direction.

5. The infant carrier of claim 4, wherein the lever includes a lever body having the input surface, a pivot flange coupled to the lever body to extend toward the handle axis and mate with the latch body, and an actuator ramp appended to the lever body and having an opposite ramp-engagement surface that faces opposite the input surface and mates with the locator wedge of the lock block to cause the lock block to translate in a second direction in response to application of the input force to the input surface.

6. The infant carrier of claim 5, wherein the locator wedge has a negative slope.

7. The infant carrier of claim 2, wherein a handle hub included in the carrier handle is formed to include a lock-block space in which a first portion of the lock block is located therein and a first hub aperture opening into the lock-block space, the lever of the handle lock is arranged to extend out of the lock-block space and through the first hub aperture to cause the input surface of the handle lock to be exposed.

8. The infant carrier of claim 7, wherein the carrier handle is formed to include a lever space and a lever aperture opening into the lock-block space and the lever extends out of the lever space through the lever aperture when the handle lock is in both the locked and unlocked positions.

9. The infant carrier of claim 8, wherein the first hub aperture opens into the lever space to cause the lever space and the lock-block space to be in communication with one another such that the first portion of the lever is in the lock-block space, a second portion of the lever is in the lever space, and a third portion of the lever is outside both the lock-block space and the lever space.

10. The infant carrier of claim 7 wherein the handle hub is formed to include a second hub aperture opening into the lock-block space and the handle axis is arranged to extend the second hub aperture.

11. The infant carrier of claim 10, wherein a second portion of the lock block is arranged to extend out of the lock-block space through the second hub aperture along the handle axis.

12. The infant carrier of claim 1, wherein the seat bucket includes a bucket body formed to include the seat channel and a handle socket coupled to an outer surface of the bucket body to extend away from the seat channel and the carrier handle mates with and couples to the handle socket.

13. The infant carrier of claim 12, wherein the carrier handle includes a grip adapted for gripping by a caregiver when the carrier handle is in the carry position and a handle hub coupled to one end of the carrier handle to move therewith and mate with the handle socket of the bucket body.

14. The infant carrier of claim 13, wherein the handle lock further includes a lock block coupled to the carrier handle to slide back and forth between the locked and unlocked positions and a lever coupled to the carrier handle to pivot about the handle axis between the locked and the unlocked position and the lever provides the inpul surface and the lock block is positioned to lie in a hub space defined to be between the handle socket of the seat bucket and the handle hub.

15. The infant carrier of claim 14, wherein the handle socket of the seat bucket is formed to include a storage slot configured to receive the lock block therein when the carrier handle is in the storage position and a carry slot configured to receive the lock block when the carrier handle is in the carry position.

16. The infant carrier of claim 14, wherein the lock block slides along a linear path relative to the grip in response to application of the input force from the user.

17. An infant carrier comprising a seat bucket adapted to support a child sitting on the infant carrier, a carrier handle including a forward surface and an opposite rearward surface spaced apart from the forward surface, the carrier handle being coupled to the seat bucket to move about a handle axis between a storage position and a carry position, and a handle lock having a first end and a second end, the handle lock coupled to the carrier handle to move relative to the carrier handle between a locked position in which the handle lock blocks movement of the carrier handle relative to the seat bucket and an unlocked position in which the carrier handle is free to move relative to the seat bucket, wherein the handle lock includes a lock block coupled to the carrier handle to slide back and forth between the locked and unlocked positions and a lever coupled to the carrier handle to pivot about a lever axis between the locked and the unlocked position and the lever provides an input surface that extends between the first and second ends of the handle lock, the first and second ends of the input surface arranged in collinear relation with the forward surface of the carrier handle when the handle lock is in the locked position and wherein an input force is applied to the input surface to cause the handle lock to assume the locked position.

18. The infant carrier of claim 17, wherein the lever axis is aligned with the handle axis.

19. The infant carrier of claim 17 wherein the lock block abuts against a socket formed in the seat bucket to retain the carrier handle in the storage position and the carry position.

20. The infant carrier of claim 19, wherein the socket includes at least one slot for receiving the lock block of the handle lock therein when the handle lock is in the locked position.

21. The infant carrier of claim 20, wherein the carrier handle is in the carry position when the lock block is received in the at least one slot.

22. The infant carrier of claim 19, wherein the socket includes at least two slots for receiving the lock block of the handle lock therein when the handle lock is in the locked position.

23. The infant carrier of claim 22, wherein the carrier handle is in the carry position when the lock block is received in one of the at least two slots and is in the storage position when the lock block is received in another one of the at least two slots.

24. The infant carrier of claim 23, wherein the at least two slots are spaced away from each other by a support platform that supports the lock block therein during movement of the carrier handle between the carry position and the storage position.

25. The infant carrier of claim 24, wherein the lock block is biased to engage the support platform by a spring coupled to the lock block.

26. The infant carrier of claim 17, wherein the handle lock further includes a spring positioned to lie between the lock block and the carrier handle and configured to provide a bias force to the lock block to urge the lock block and the lever to assume the locked position.

27. The infant carrier of claim 26, wherein the lock block includes a latch body, a locator wedge appended to the latch body to extend away from the handle axis in a first direction, and a spring mount appended to the latch body to extend away from the handle axis in an opposite second direction.

28. The infant carrier of claim 27, wherein the lever includes a lever body having the input surface, a pivot flange coupled to the lever body to extend toward the handle axis and mate with the latch body, and an actuator ramp appended to the lever body and having an opposite ramp-engagement surface that faces opposite the input surface and mates with the locator wedge of the lock block to cause the lock block to translate in a second direction in response to application of the input force to the input surface.

29. The infant carrier of claim 28, wherein the locator wedge has a negative slope.

* * * * *